US006097668A

United States Patent [19]

Hopkins

[11] Patent Number: 6,097,668

[45] Date of Patent: Aug. 1, 2000

[54] COMPONENT DEPLOYMENT MEANS FOR ICE PENETRATING ACOUSTICS COMMUNICATION RELAY SYSTEM

[75] Inventor: Wayne J. Hopkins, College Park, Md.

[73] Assignee: The United States of America as represented by the Secretary of Navy, Washington, D.C.

[21] Appl. No.: 05/703,047

[22] Filed: Jul. 2, 1976

[51] Int. Cl.[7] ..... H04B 1/59

[52] U.S. Cl. ..... 367/4

[58] Field of Search ..... 340/2, 5 R, 6 R; 367/3, 4; 114/326; 441/33

[56] References Cited

U.S. PATENT DOCUMENTS 3,248,689 4/1966 Shomphe et al. .
3,818,523 6/1974 Stillman, Jr. .
3,859,598 1/1975 McElwain .

*Primary Examiner*—Daniel T. Pihulic

[57] ABSTRACT

In an air-delivered, ice-penetrating, acoustic communications package, means are provided to ensure that subsurface electronic components are safely deployed under the ice layer. The package comprises a shaped penetrator probe and a separable, interconnected sonobuoy system having a buoyant, signal transmitting section, a buoyant, signal converting section and subsurface signal detecting components. The subsurface components are housed within a canister extractable from the aft end of the probe and connected to the afterbody by a heavy-duty shock cord coupled with a lighter connecting cord. After ice penetration, the antenna section, afterbody and probe separate, with the antenna section and after-body remaining above the ice/water interface. The probe descends, paying out the shock cord to extract the component canister. The canister separates and the components are deployed full depth via the connecting cable.

6 Claims, 2 Drawing Sheets

FIG. 1B
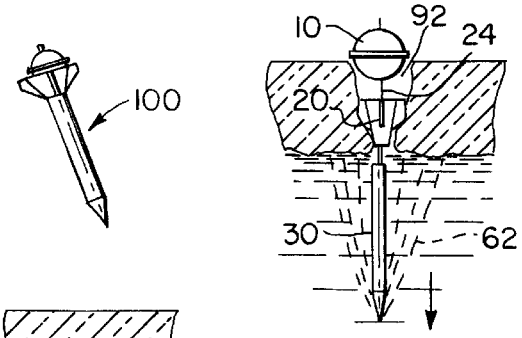
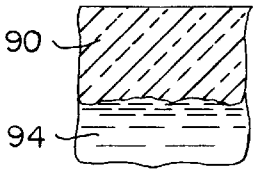
FIG. 1A
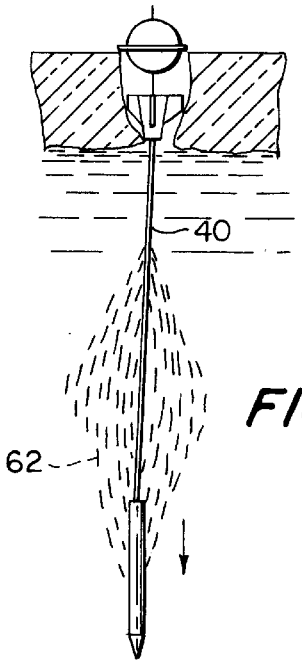
FIG. 1C
FIG. 1D
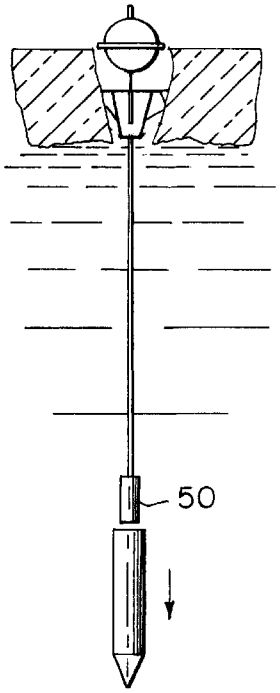
FIG. 1E
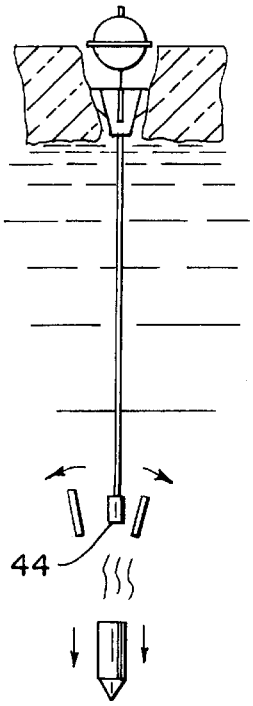
FIG. 1F
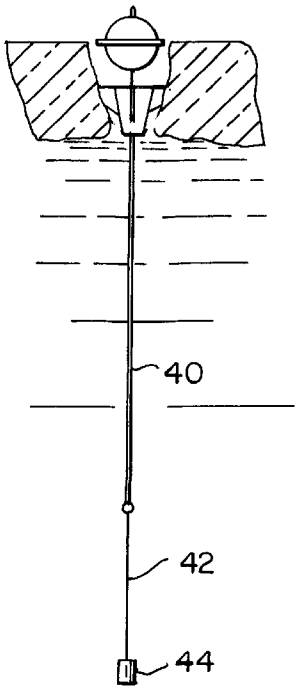

COMPONENT DEPLOYMENT MEANS FOR ICE PENETRATING ACOUSTICS COMMUNICATION RELAY SYSTEM

BACKGROUND OF THE INVENTION

This invention relates generally to sonobuoys and more particularly to the deployment of sonobuoys through an ice layer.

The Artic ice pack presents a formidable barrier to anti-submarine warefare systems. A sonobuoy system deployed under the ice could provide a capability for monitoring submarine movements. Existing sonobuoy systems are generally not sufficiently rugged to provide penetration capability in an ice mass of unknown thickness and yet still protect internal equipment from the forces encountered during ice penetration and water entry.

An existing, experimental probe system disclosed in U.S. patent application, Ser. No. 441,202 filed by Feltz et al on Feb. 5, 1974 consists of a penetrator to perforate the ice, an afterbody to house the sonobuoy electronics, hydrophone and cable, and an antenna section. Each of the three parts separate during ice penetration, with the afterbody remaining interconnected to the antenna section by an umbilical line of coaxial cable. The afterbody and antenna sections are buoyant, and the antenna remains at the ice surface after penetration. A hydrophone is then released at this time and suspended from the afterbody. The afterbody may remain embedded in the ice layer if the layer is of considerable thickness, or it may penetrate a thin layer of ice and remain afloat beneath the ice.

This system has several disadvantages. The afterbody must be of a certain density or buoyancy to work properly and also be of a certain size and shape to have the proper coefficient of drag in the water if it penetrates through a thin ice layer. The probe must have a certain weight per area ratio and have a high percentage of the system weight in order to achieve successful penetration of the ice layer. These requirements on the probe mean that with a small increase in the weight of the components carried within the afterbody, a dynamic imbalance would be created on the overall system, resulting in the limitation that only very small electronic, acoustic and power generating components could be carried within and be deployed from the afterbody.

Since the antenna section and the afterbody section are decelerated completely at or shortly after ice impact, and since most of the sensitive electronics equipment is within the after-body, this equipment is subjected to extreme shock loads which may seriously affect the reliable operation of the system.

Another significant problem with this experimental system is that the hole bored through the ice does not always remain clear to permit a hydrophone to be dropped into the water below the ice. The afterbody would plug the top of the hole and trap air in the cavity made by the probe, allowing water to flow a few inches up into the hole, compressing the air. The water in the hole contains crushed ice or slush that sometimes prevents the hydrophone and/or other components from falling into the seawater. The hydrophone is released from the afterbody after the sonobuoy system has come to rest, with the hydrophone release being delayed to avoid the difficult problem of designing a system that would be capable of deploying the hydrophone from the probe during ice penetration at a high speed and still bring the hydrophone safely to rest at the desired depth. Further, the compressed air entrapped within the hole precludes the use of sea water-activated batteries since seawater cannot reach the battery located in the after-body.

SUMMARY OF THE INVENTION

An object of this invention is to provide a sonobuoy system for use in ice fields.

Another object of this invention is to provide a means of protecting sonobuoy components during deployment under ice-covered sea regions.

Another object of this invention is to provide means to absorb the impact loads on a sonobuoy during deployment below an ice layer.

Yet another object of this invention is to provide safe and reliable means of deploying sensitive sonobuoy components below an ice layer.

Still another object of this invention is to provide increased storage capacity for aerially-delivered sonobuoy components.

Briefly, in accordance with one embodiment of this invention, these and other objects are attained by providing an interconnected sonobuoy system, intended to be air delivered over sea regions covered by ice, with improved means for protectively deploying sonobuoy signal detecting components below the ice surface. The sonobuoy system components are detachably secured to a shaped penetrator probe, with the signal converting and signal transmitting equipment remaining above the ice/water interface after ice penetration. An enclosure for protectively housing the signal detecting components and a connecting length of cable is stowed within an aft recess of the probe. A length of heavy-duty shock cord connects the cable with the remainder of the sonobuoy system, said cord being suitable for withdrawing the enclosure and cable from the probe subsequent to penetration of the layer.

BRIEF DESCRIPTION OF THE DRAWINGS

Still other objects, advantages and features will become apparent by reference to the following detailed description of a preferred embodiment of the apparatus and method and the appended claims. The various features of the exemplary embodiments according to the invention may be best understood with reference to the accompanying drawings wherein:

FIGS. 1(*a*)–1(*f*) is a sequence diagram showing the stages of deployment of the present invention.

DESCRIPTION OF THE PREFERRED EMBODIMENT

Figure 2:
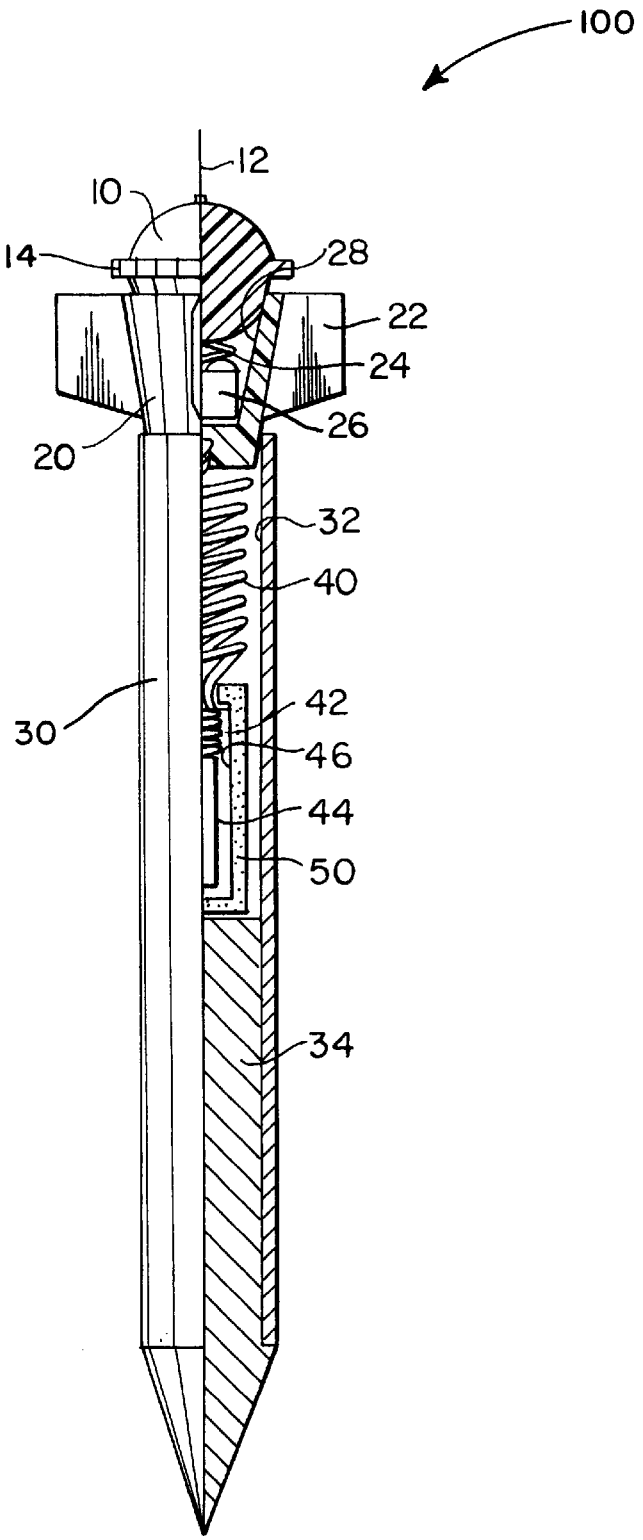
FIG. 2 shows the apparatus, partly in section.

Referring now to the drawings wherein like reference characters designate identical or corresponding parts throughout the several views, in FIG. 1 an operational sequence is shown wherein the sonobuoy system is being deployed. The sonobuoy system 100 is shown in FIG. 1(*a*) shortly after being dropped from an aircraft (not shown) and directed at an ice layer 90 overlying the sea 94. In FIG. 1(*b*), the system is shown perforating the ice layer and releasing a buoyant antenna unit 10 and a buoyant afterbody unit 20 which houses signal converting equipment embedded in a protective material, each of said units being interconnected by means 24. The units are releasably carried on the aft end of a penetrator probe 30 and are released when the penetrator bores through the ice layer 90. A cavitation zone 62 is created as the probe impacts the water.

In FIG. 1(*c*), the probe 30 is shown falling from the ice layer—water interface and paying out a heavy-duty shock cord 40 from a stowage recess located at the aft portion of the probe. The afterbody unit 20 is shown lodged within the hole bored in the ice. This would be the situation when the ice layer is thick; for thin ice layers, the afterbody unit and the probe will completely penetrate therethrough, and the afterbody will most probably float just below the ice layer 90. The fully-developed cavitation zone is shown in FIG. 1(*c*) collapsing around the shock cord 40. If the signal sensing equipment were caught in this collapsing zone, it would be subject to considerable forces and pressures. After the shock cord has been fully extended, as in FIG. 1(*d*), a protective canister 50 is extracted from the aft, stowage recess of the probe, said canister being suitable for protectively deploying signal detecting means. In FIG. 1(*e*), the canister 50 is shown separating from the signal detecting means 44, such as a hydrophone. A length of coaxial signal cable and/or power cable 42 allows the detecting means in FIG. 1(*f*) to descent to the predetermined depth.

Referring now to FIG. 2, the air delivered sonobuoy system 100 comprises an elongated cylindrical probe 30 in combination with an interconnected, three-part sonobuoy suitable for aircraft release in an ice field. The probe has an aft stowage chamber 32 and a shaped, pointed forward section 34 of material suitable for penetrating ice. The sonobuoy includes the antenna section 10, disclosed in U.S. patent application, Ser. No. 441,202 filed by Feltz et al on Feb. 5, 1974 after the signal-converting afterbody 20, and the signal detecting means 44. The antenna section is of buoyant material and has an antenna 12 extending therefrom. The buoyant afterbody 20 has a recess 28 suitable for releasably receiving the antenna section, and has a signal converting means and power supply 26 housed therein. A connector 24 joins the antenna section to the afterbody and also provides support for cables that transmit signal between the signal converting and the antenna sections. The antenna and afterbody combination is releasably supported in the aft recess 32 of the probe 30. Aerodynamic fins 22 positioned on the afterbody and a circumferential burble fence 14 on the antenna section help to stabilize the fall of the system 100 and ensure nearly-perpendicular impact with the ice layer.

Signal detecting means 44, such as a hydrophone, is housed withinthe protective canister 50, and the unit is received within the recess 32 of the probe. The canister may be of a water soluble material or may be designed to separate and break away from the signal detecting means, or be stripped away by hydrodynamic forces. The heavy-duty shock cord 40 is carried within the probe recess and serves to interconnect the signal detecting/protective canister unit with the signal converting afterbody 20. Power and signal transmitting cables 42 also connect the signal detecting means 44 with the signal converting section 20. These cables are of a longer length than the shock cord 40, with the excess length being stored within the interior of the protective canister. The purpose of the shock cord is to absorb the loads of the decelerating probe after ice impact and to withdraw the canister 50 from the probe, whereas the umbilical cable is designed to permit the hydrophone to be deployed to greater depths, but yet not be required to withstand substantial loads. Using the smaller and less bulky umbilical cables to deploy the signal detecting means to the desired depth after being released from the protective canister requires much less volume in the probe. This permits more electronic signal detecting components with their associated weights to be placed in the probe stowage recess 32 for deployment without greatly increasing either the size or the weight of the entire system. Placement of these components in this recess, where weight is not a problem, would not create any dynamic imbalance upon the size and weight of the system as it would were the components to be placed aft of the probe, within the afterbody.

Operationally, (note FIGS. 1) the sonobuoy would be aerially delivered to an ice-covered sea region and dropped. The probe will impact and perforate the ice layer. During impact, the afterbody and the antenna sections are released from the probe, with the afterbody being lodged within the hole. The fins, although not essential to the deployment of the signal detecting means, provide an additional benefit in that they serve to brake the descent of the afterbody in the ice layer. The probe, which carries the signal detecting means within the protective canister, continues downward, paying out the shock cord. Components in the probe will experience a much lower level of deceleration than the signal converting components that are embedded within the protective material of the afterbody since the afterbody comes to rest within a few inches of the ice surfaces, whereas the probe will lose only a small portion of its velocity upon impact and will continue travelling downward. The shock cord is long enough to permit the protective canister to escape the collapsing water cavity and, upon full extension, will ultimately pull the canister from the aft recess of the probe. Even if the canister should be caught within the collapsing cavitation zone, it helps protect the contents thereof from the resulting forces. The protective canister allows the signal detecting components to be withdrawn from the probe recess without placing an undue strain on the components themselves or the umbilical signal cables. After the canister has been fully withdrawn, it separates to expose the signal detecting components, which then deploy downward at a much lower velocity than that at which they were delivered through an ice layer at impact. This lower velocity permits less rugged signal umbilical cables to be used for deployment to the ultimate depth.

While the foregoing description illustrates the present invention used with the standard passive-type sonobuoy, in which one or more acoustic transducers are suspended in the water to detect sonic signals, the invention is also applicable with other types of acoustic communications package. For example, if the sonobuoy system were to receive as well as to transmit radio signals, then the signal transmitting or antenna section 10 would include the necessary antenna equipment. Similarly, if the system generates acoustic signals as well as detects such signals, then the electronic equipment package, along with the required power source, would be packaged in the storage compartment 32 of the probe, and would be deployed in the same fashion as the hydrophone 44 of the foregoing description. Accordingly, the term "sonobuoy system" as used in the present description and the claims appended hereto would encompass all equivalents and modifications of the sonobuoy system illustrated herein.

Obviously, numerous modifications and variations of the present invention are possible in light of the above teachings. It is therefore to be understood that within the scope of the appended claims the invention may be practiced otherwise than as specifically described herein. For example, the connection between the signal converting and the signal detecting sections may be by means of a multistranded cord having individual cord elements that possess differing elastic properties.

What is claimed as new and desired to be secured by letters patent of the United States is:

1. A sonobuoy system for deployment in ice-covered regions comprising:

an elongated, weighted probe having one end portion shaped for penetration through ice and a storage compartment adjacent to the other end portion;

a buoyant, signal converting unit separably connected to said probe adjacent to said storage compartment;

a buoyant, signal transmitting unit separably coupled to said converting unit and to said one end;

acoustic signal detecting means; and a separable protective container to house said signal detecting means, both of said container and said detecting means being releasably positioned within said storage compartment, said protective container separates from said signal detecting means subsequent to extraction from said storage compartment;

whereupon deployment, the operational sequence of said system is that said probe penetrates through the ice layer; said converting and transmitting units separate and remain afloat, and said detecting means is released and deployed under the ice layer.

2. The sonobuoy system of claim 1 further including a first flexible line within said storage compartment connecting said protective container to said signal converting unit, said first line being deployed subsequent to probe penetration of the ice layer to extract said container from said storage compartment.

3. The sonobuoy system of claim 2 further including a second flexible line longer than said first flexible line, positioned within said storage compartment and said container, and supporting a communication link between said signal detecting means and said signal converting unit, said second line being extended subsequent to extraction of said container to position said detecting means at a predetermined depth.

4. The sonobuoy system of claim 1 further including guidance fins on said signal converting unit to stabilize the system during deployment and to brake said converting unit upon impact with the ice.

5. The sonobuoy system of claim 1 wherein said protective container comprises a partitioned canister which separates to expose the signal detecting means.

6. The sonobuoy system of claim 1 wherein said protective container is of a soluble material which dissolves in seawater to expose the signal detecting means.

* * * * *